US005261997A

United States Patent [19]

Inselmann

[11] Patent Number: 5,261,997

[45] Date of Patent: Nov. 16, 1993

[54] APPARATUS FOR BONDING TEXTILE SHEET-LIKE STRUCTURES

[75] Inventor: Jürgen Inselmann, Löhne, Fed. Rep. of Germany

[73] Assignee: Herbert Kannegiesser GmbH & Co., Fed. Rep. of Germany

[21] Appl. No.: 842,996

[22] Filed: Feb. 28, 1992

[30] Foreign Application Priority Data

Mar. 19, 1991 [DE] Fed. Rep. of Germany ..... 4108936

[51] Int. Cl.[5] ..... B30B 12/00; B32B 31/00

[52] U.S. Cl. ..... 156/580; 100/138; 156/580; 156/583.1; 156/583.3

[58] Field of Search ..... 156/580, 583.1, 583.3, 156/556, 563; 38/5, 7, 54; 100/138, 141

[56] References Cited

U.S. PATENT DOCUMENTS 2,646,105 7/1953 Langer ..... 1256/580 X
4,897,147 1/1990 Inselmann ..... 156/580 X

FOREIGN PATENT DOCUMENTS 1921100 1/1972 Fed. Rep. of Germany .
7738889 12/1977 Fed. Rep. of Germany .
3303504 12/1985 Fed. Rep. of Germany .

*Primary Examiner*—David A. Simmons
*Assistant Examiner*—Paul M. Rivard
*Attorney, Agent, or Firm*—Sughrue, Mion, Zinn, Macpeak & Seas

[57] ABSTRACT

Apparatuses for bonding textile sheet-like structures comprise a supporting disc (23) for receiving the textile pieces which are to be bonded or the ready bonded textile sheet-like structures (20), and covering means which cover these textile pieces. The covering means have to be folded up at least in a feed and discharge station (27) in order to give access to the textile sheet-like structures (20). This process requires a lot of work and unnecessarily extends the working cycle of the apparatus. In the apparatus according to the invention, the covering means is in the form of a flexible covering disc (26) which covers the supporting disc and which can be curved up in a positively guided manner at least in the region of the feed and discharge station (27). As a result, a circle segment (33) of the covering disc (26) is automatically lifted off the supporting disc (23) in the region of the feed and discharge station (27). The apparatus according to the invention is particularly suitable for producing collars, cuffs etc. for outerwear garments.

22 Claims, 13 Drawing Sheets

APPARATUS FOR BONDING TEXTILE SHEET-LIKE STRUCTURES

DESCRIPTION

Figure 1:
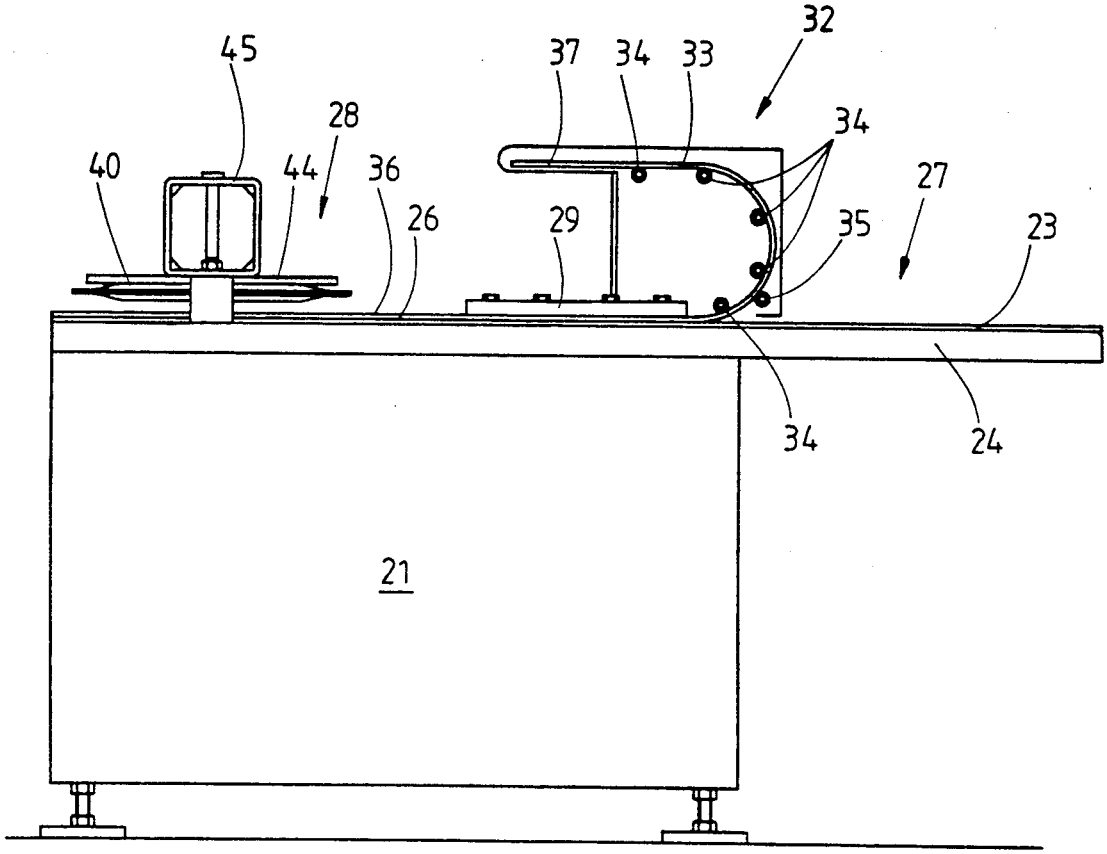

The invention relates to an apparatus for bonding textile sheet-like structures, especially collars, cuffs or the like, with a rotatably drivable receiving means for further transporting the textile sheet-like structures which comprises preferably several work stations, and with at least one covering means which is movable together with the receiving means and which covers the textile sheet-like structures in the region of at least one work station.

Especially in the manufacture of ready-made outerwear garments, textile sheet-like structures in the form of outerfabrics and interlinings are bonded to one another in order to produce for example collars and cuffs. Fabrics and interlinings are usually bonded adhesively by means of a simultaneous application of heat and pressure.

Such an apparatus for bonding textile sheet-like structures is known from German Utility Model 77 38 889. This apparatus comprises a receiving means in the form of a rotary table which is associated with several work stations. The receiving means comprises as many covering means as there are work stations. The covering means which is located in the region of a work station in the form of a feed station has to be manually folded open in order to extract the bonded textile sheet-like structures and has to be manually folded shut after textile sheet-like structures which are due to be bonded have been placed on the receiving means. These steps are very time-consuming and extend the working cycle of the known apparatus.

The invention is therefore based on the object to increase the degree of automatization in this species of apparatus.

To attain this object, the apparatus according to the invention is characterized in that the covering means is in the form of an elastically deformable covering disc which is operatively connected to a deflecting device and can be curved up by the deflecting device in such a way that the receiving means is uncovered in the region of at least one work station in order to feed and/or discharge textile sheet-like structures. As a result of the elastically deformable design of the covering disc according to the invention, said disc can be curved up at least in the region of one work station (preferably the work station where there is a feed and/or discharge) in a positively guided manner. Thus, the covering means does not have to be manually folded open and shut like in prior art apparatuses. In the apparatus according to the invention, this results in a reduction of manual labor so that bonded textile sheetlike fabrics can be discharged and replaced with unbonded fabric faster. Consequently, the cycle time of the apparatus according to the invention is reduced.

The covering disc moves relative to the deflecting device by which it is curved. As a result of this relative movement, a portion of the covering disc is deformed when it passes through the deflecting device, such that the covering disc is deflected in the region of a feed station and of a discharge station combined with or separate from the feed station.

According to a development of the apparatus, the covering disc extends over all work stations. This allows an easy curving of portions of the covering disc, because the upfolded portion of the covering disc is joined to the remaining portion of the covering disc which covers the supporting disc, so that while the covering disc moves further, a portion of the covering disc is placed back onto the supporting disc and another portion is curved up again in a continuous manner.

According to a further development of the invention, the deflecting device is fixedly attached to the apparatus, so that the relative movement which is necessary for curving the covering disc is automatically effected by the drive of the covering disc.

According to a further exemplary embodiment of the invention, a work station in the form of a pressing station is associated with a sheet-like pressure means, especially a pressure cushion, which is deformable by means of a pressure medium. Compared to a pressing station with pressing plates operated by pressure medium cylinders, this sheet-like pressing means has the advantage that it requires a smaller pressure stroke and reduces the cycle time of the pressing station, thus matching the reduction of the cycle time resulting from the curving of a portion of the covering disc in the region of the feed and discharge station.

A relatively thin design of the covering disc also adds to a reduction of the cycle time of the apparatus according to the invention. The small height of the covering disc only requires a short idle stroke of the pressure means in the pressing station so that the pressing station can be opened and closed very rapidly. This effect is increased, if according to a further embodiment of the invention the supporting disc is also designed to be thin.

A pressure cushion operated by compressed air is a particularly suitable pressure means, which can rapidly exert an even pressure. If the pressure cushion is directly assigned to a disc, especially the covering disc, the combined effects of the flexible design of the covering disc and pressure cushion ensure a good adaptation to the contours of the pieces to be bonded (interlining and outerfabric).

Further features of the invention relate to the structure of the deflecting device and of the pressure cushion and its association with the supporting or covering disc.

Figure 2:
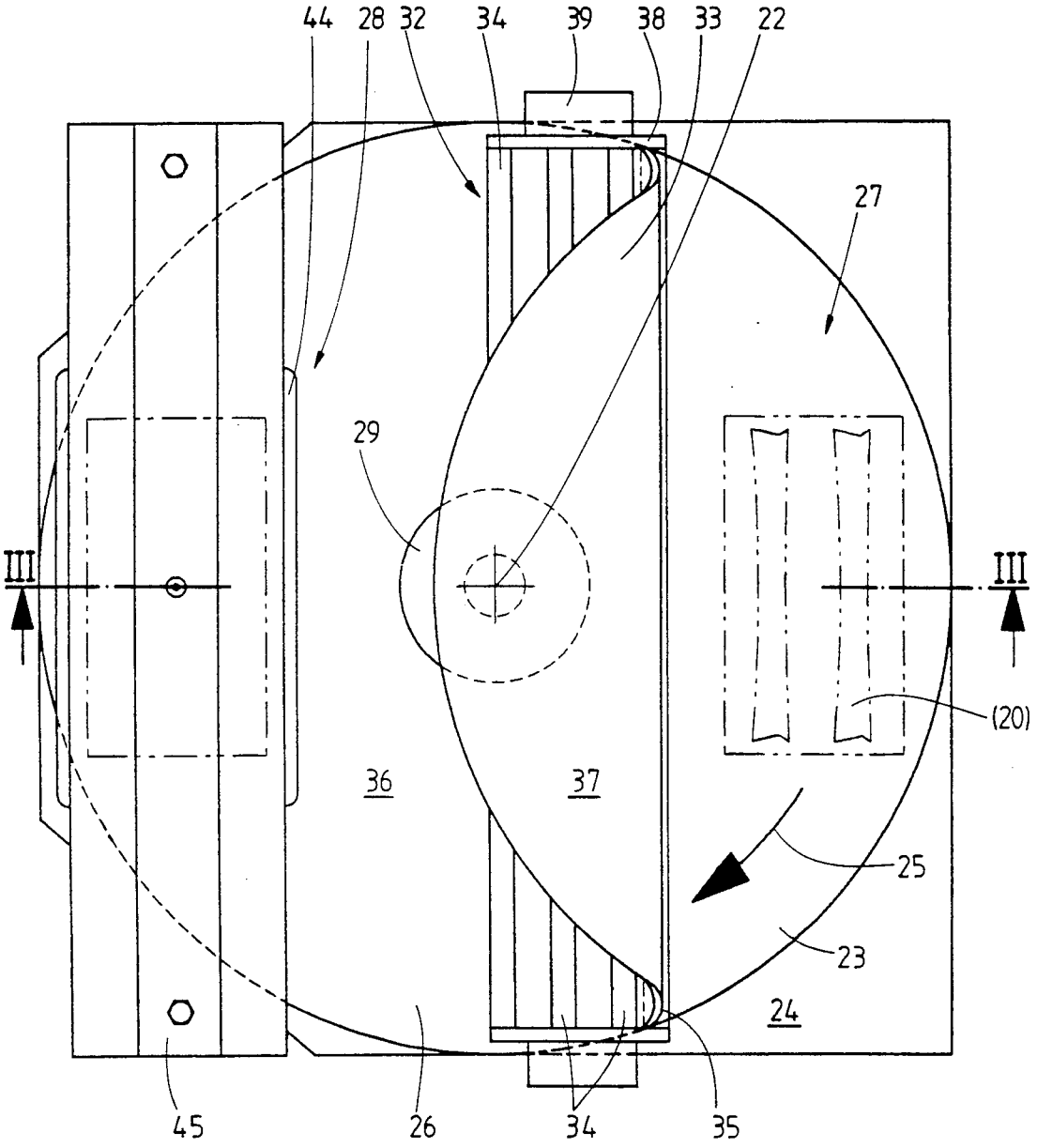
Figure 3:
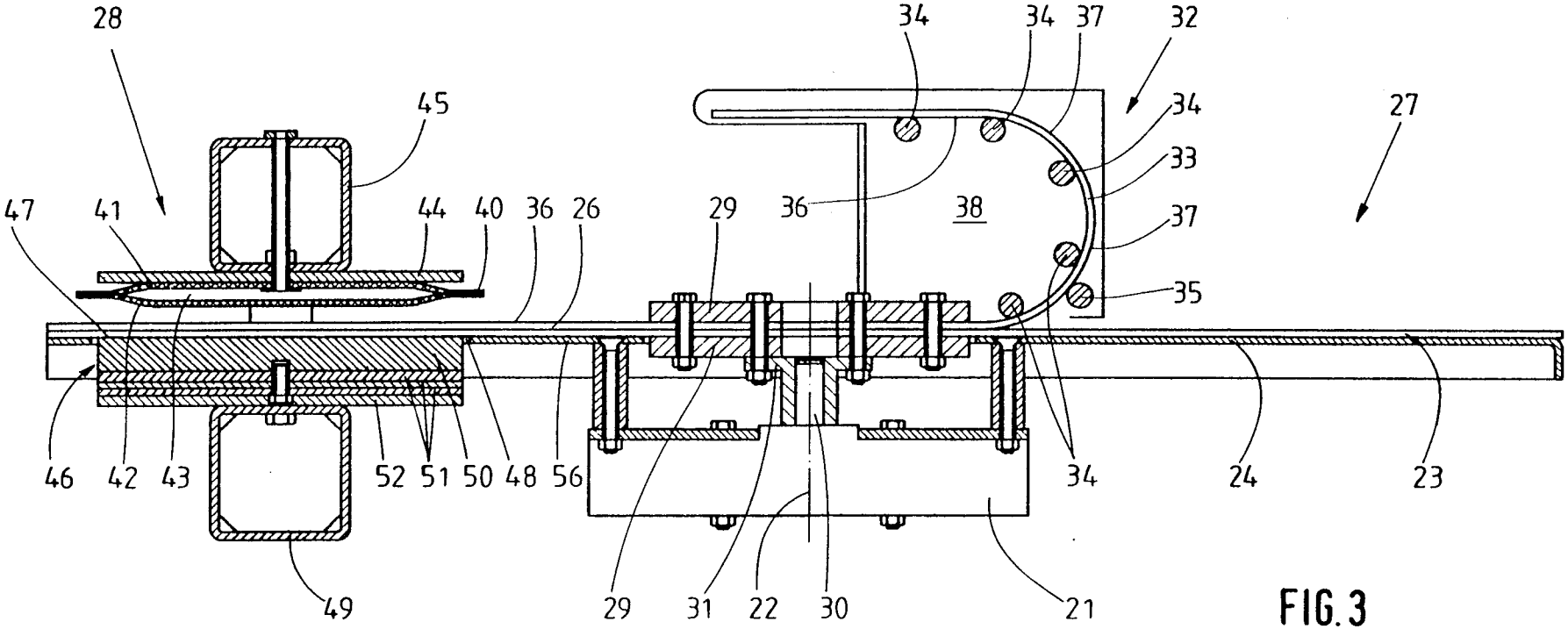
Figure 4:
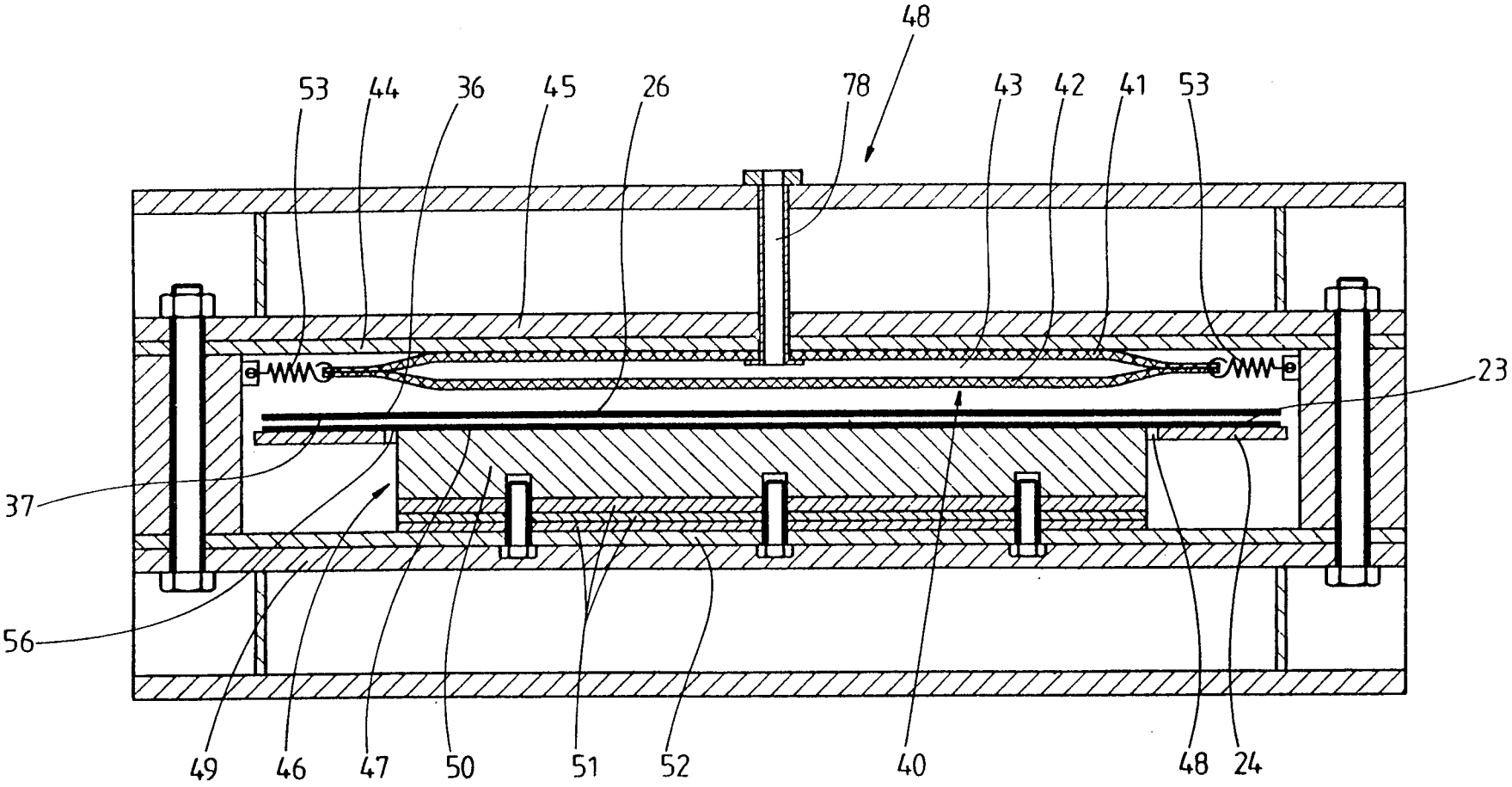
Figure 5:
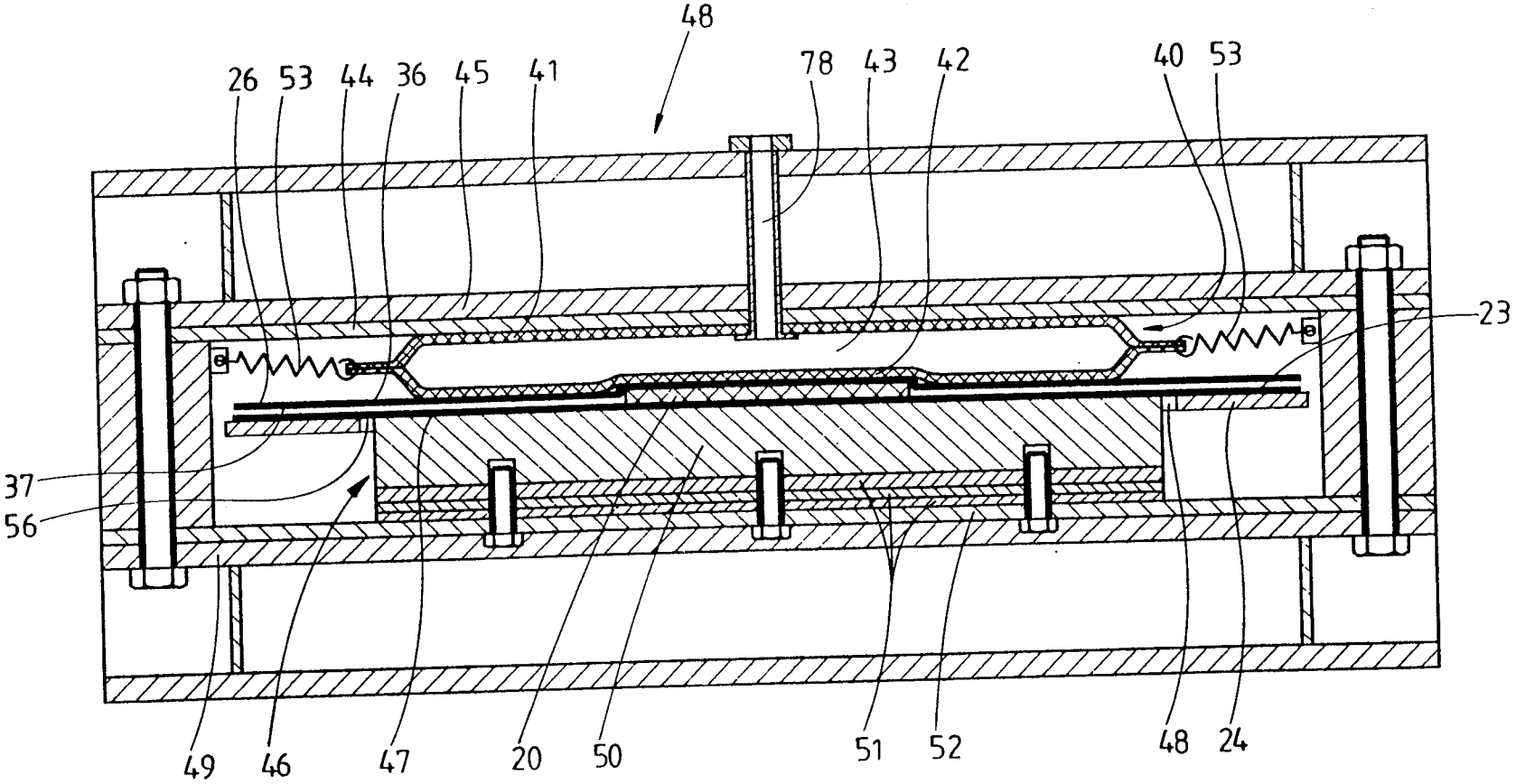
Figure 6:
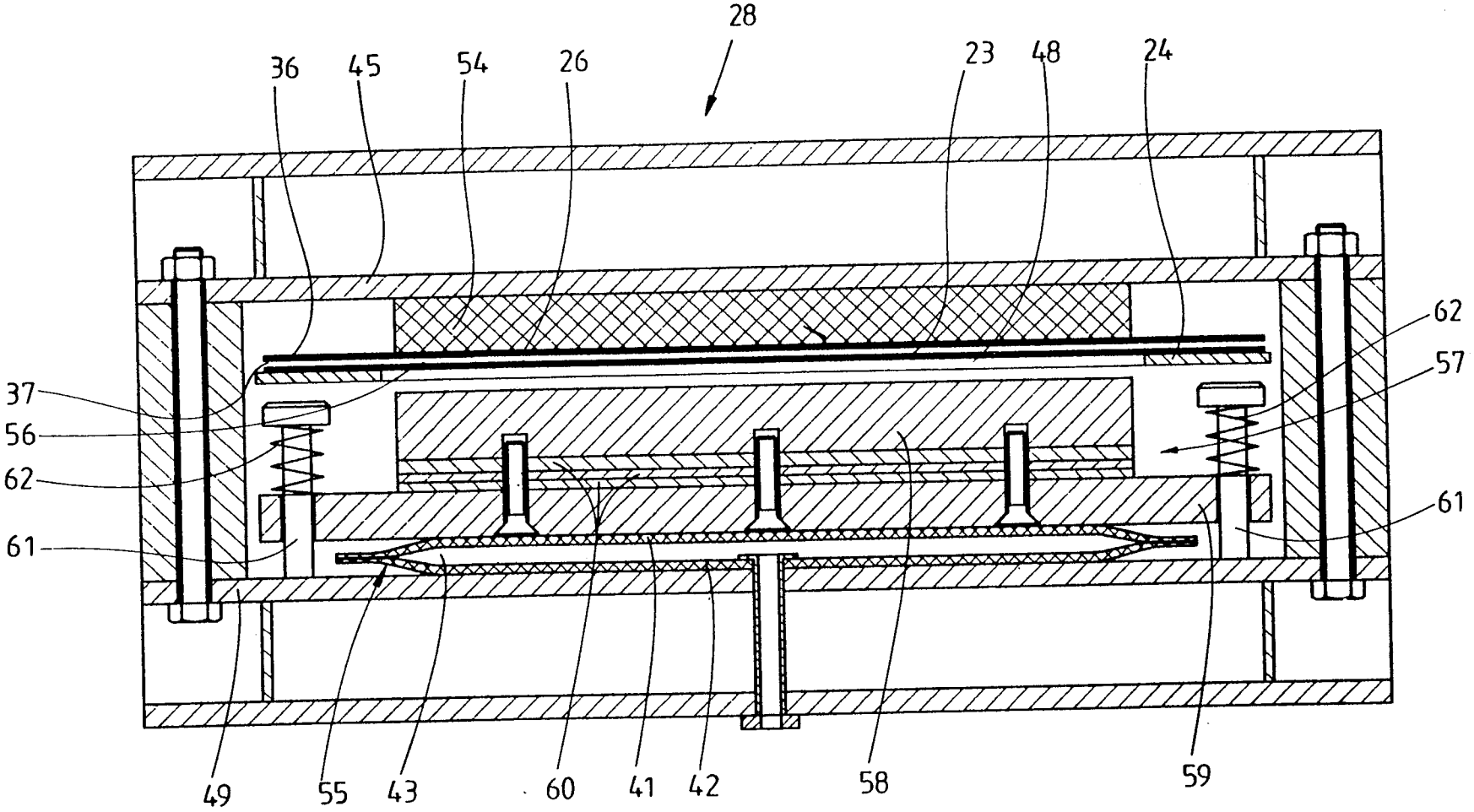
Figure 7:
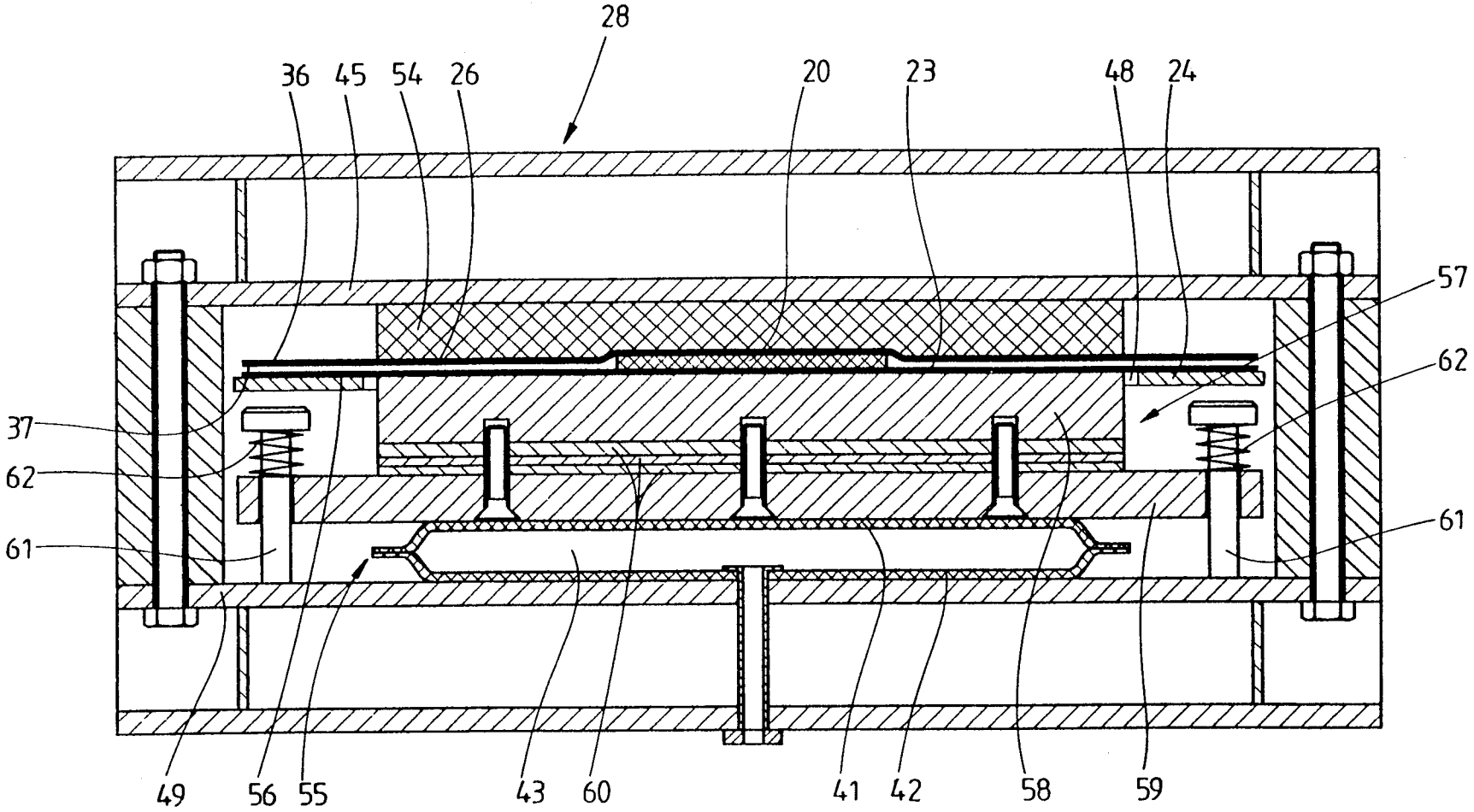
Figure 8:
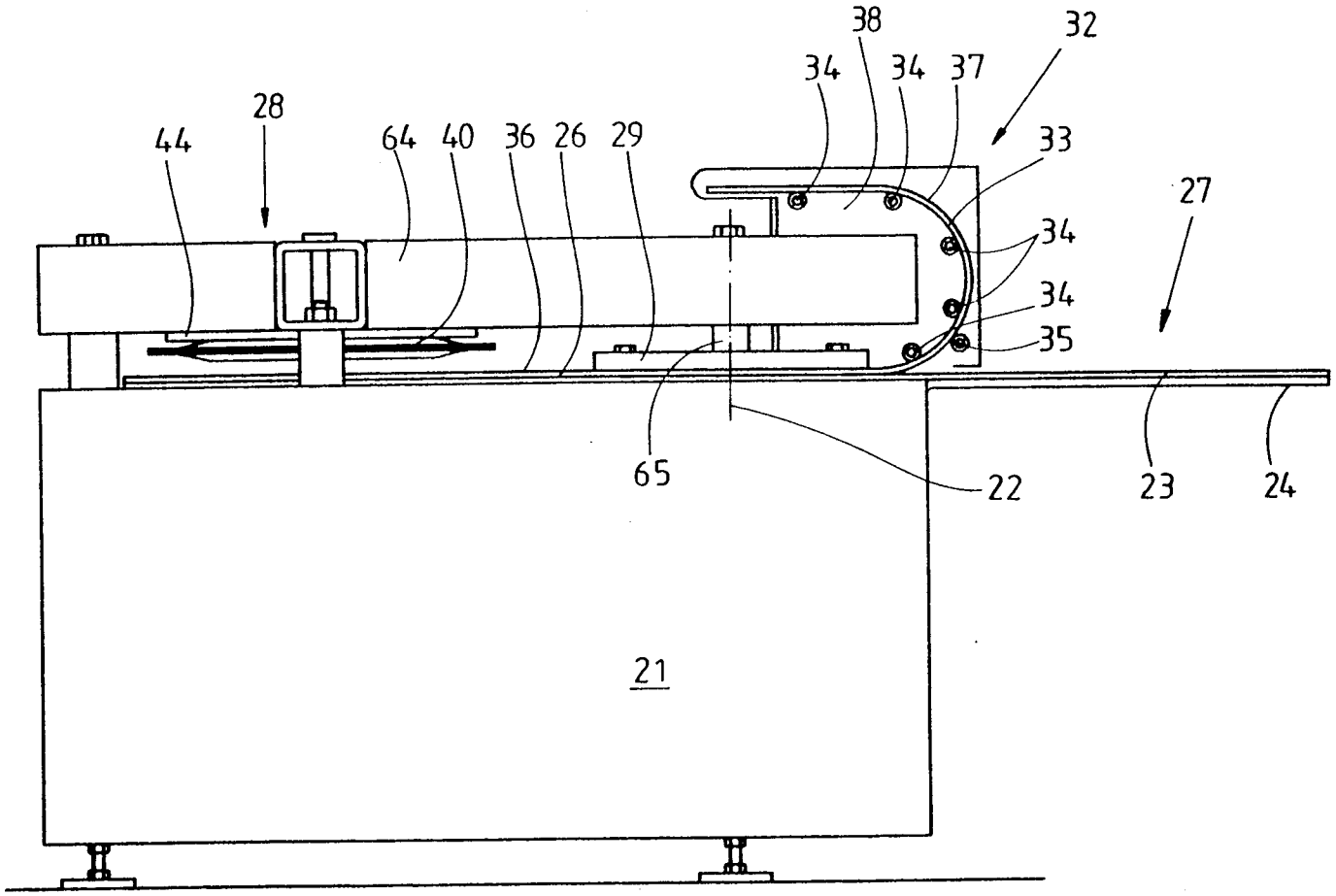
Figure 9:
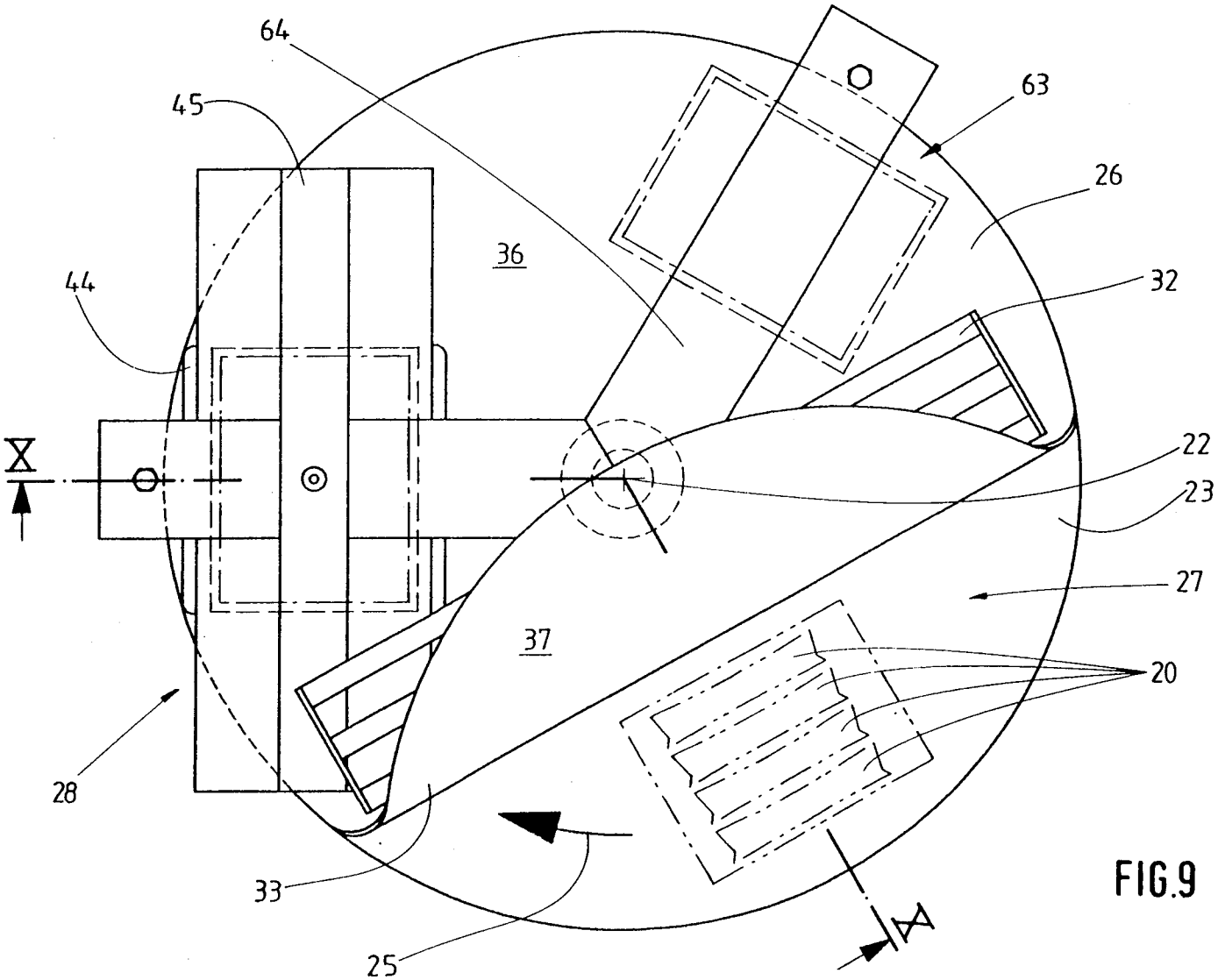
Figure 10:
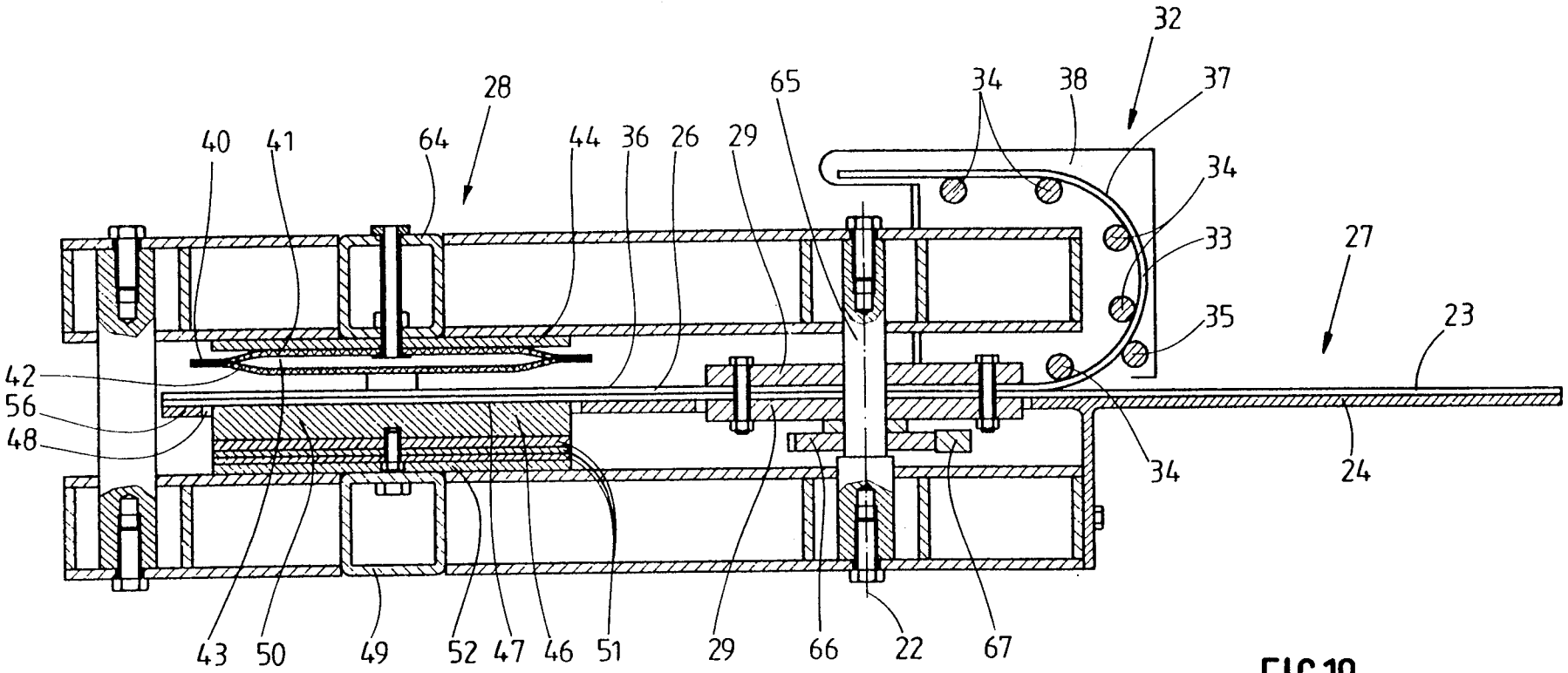
Figure 11:
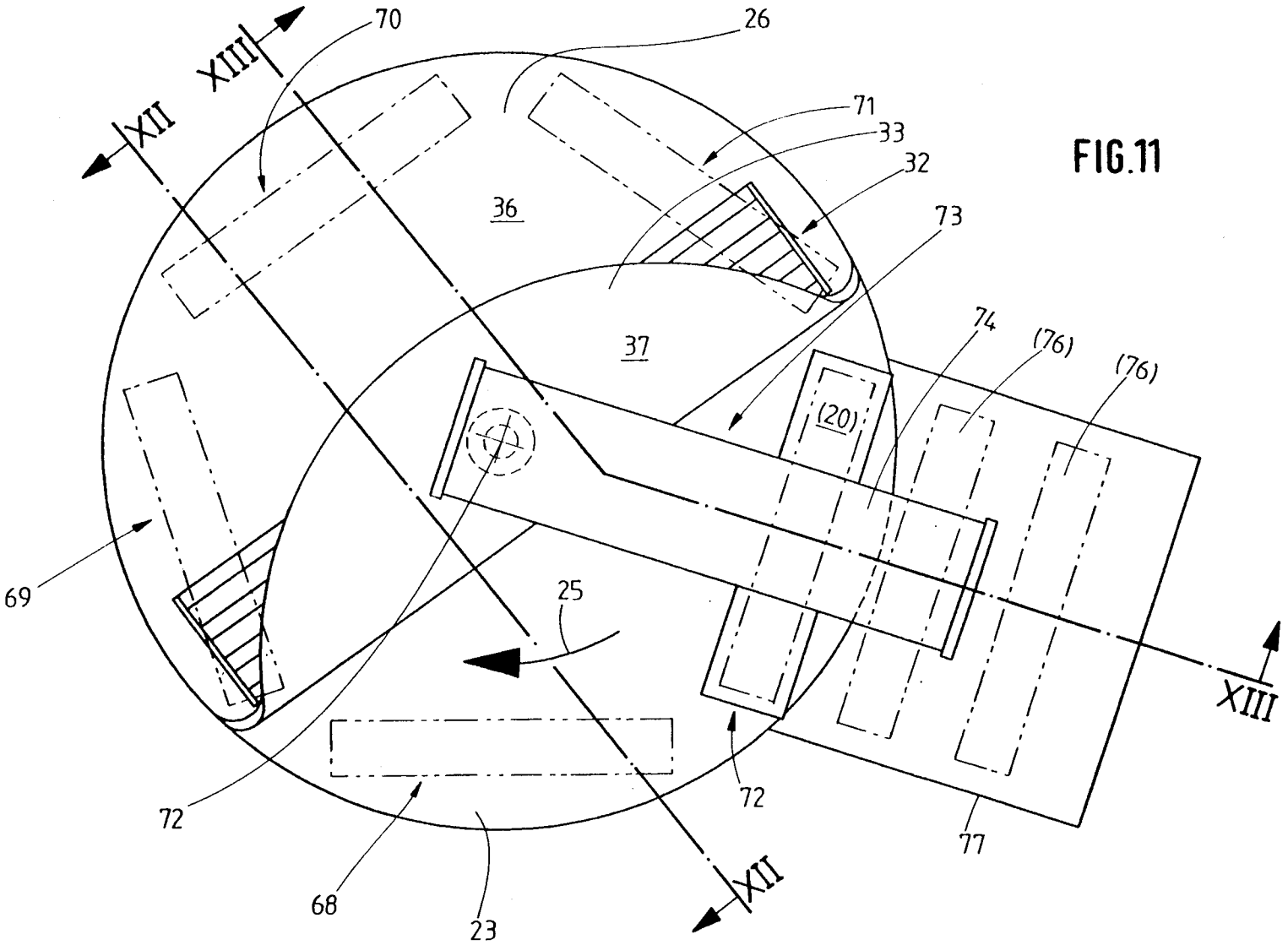
Figure 12:
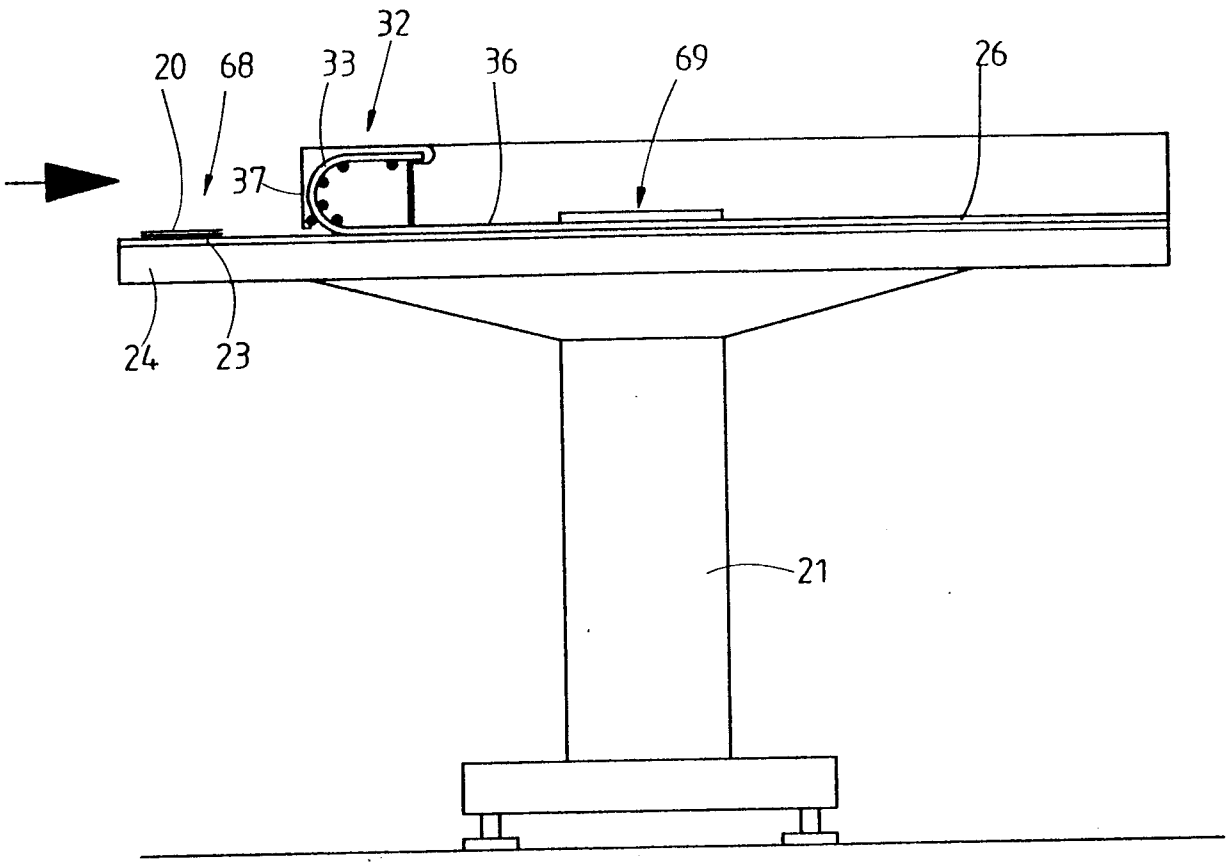
Figure 13:
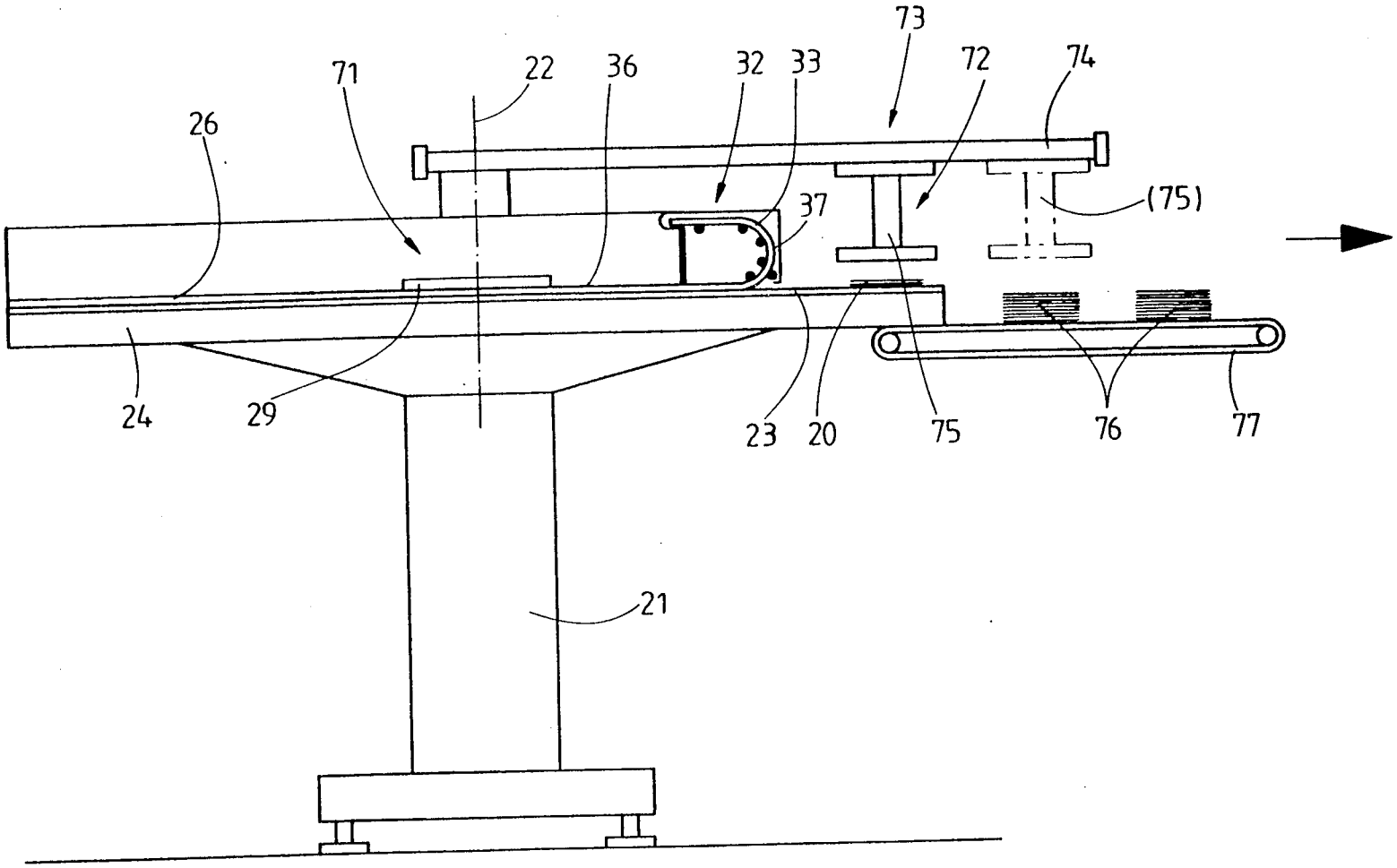

Preferred exemplary embodiments of the apparatus according to the invention will be described below in detail with reference to the drawings, in which:

FIG. 1 is a schematic side view of a first exemplary embodiment of the apparatus, FIG. 2 is a top plan view of the apparatus of FIG. 1, FIG. 3 is a cross section III—III of the apparatus of FIG. 2, shown on a larger scale than FIG. 1, FIG. 4 is a partial cross section, analogous to FIG. 3, of a pressing station of the apparatus, showing a pressure cushion which is not in a pressing position, FIG. 5 shows a view analogous to FIG. 4, with the pressure cushion being in a pressing position, FIG. 6 shows a second exemplary embodiment of the apparatus, with an alternative arrangement of the pressure cushion, in a view analogous to FIG. 4, FIG. 7 shows the apparatus of FIG. 6 in a view analogous to FIG. 5, FIG. 8 is a schematic side view of a third exemplary embodiment of the apparatus, FIG. 9 is a top plan view of the apparatus of FIG. 8, FIG. 10 is a cross section X—X of the apparatus of FIG. 9, shown on a larger scale than FIG. 8, FIG. 11 is a top plan view of a fourth exemplary embodiment of the apparatus, FIG. 12 is a section XII—XII of the apparatus of FIG. 11, and FIG. 13 is a section XIII—XIII of the apparatus of FIG. 11.

The apparatuses shown in the drawings serve for bonding textile sheet-like structures 20 (interlinings/outerfabrics) in order to form especially collars or cuffs. In some of the figures, the textile sheet-like structures 20 are sketchily illustrated with dot-dash lines.

The basic structure of the apparatus will be explained with reference to the first exemplary embodiment (FIGS. 1 to 5). The apparatus comprises a pedestal-like support base 21. Arranged thereon is a circular supporting disc 23 which is rotatably drivable about an upright axis of rotation 22.

Underneath the supporting disc 23, there is a supporting plate 24 with a circular surface area which corresponds to that of the supporting disc 23. The supporting plate 24 is rigidly attached to the support base 21, which means that the supporting disc 23 rotates on the stationary supporting plate 24 in the direction of rotation 25 (FIG. 2). A circular covering disc 26 which approximately corresponds to the surface of the supporting disc 23 is located on the supporting disc 23.

The supporting disc 23 and the covering disc 26 are associated with several work stations. In the illustrated embodiment (FIG. 2), a combined feed and discharge station 27 is located in an edge region of the supporting disc 23 and of the covering disc 26. The side of the supporting disc 23 and the covering disc 26 which is located diametrically opposite this feed and discharge station 27 is associated with a hot pressing station 28 (which forms a second work station). The feed and discharge station 27 as well as the hot pressing station 28 are fixedly attached to the support base 21.

In a region near their centers, the supporting disc 23 and the covering disc 26 are connected to one another by means of two flanges 29. These flanges 29 enclose between them the center region of the supporting disc 23 and the covering disc 26. The lower flange 29 of the two flanges is connected to a drive disc 31 which is non-rotatably arranged on a drive shaft 30 of a rotary drive which is not shown in detail. As a result, the supporting disc 23 and the covering disc 26 are simultaneously and synchronously driven to rotate, in particular discontinuously, about the central axis of rotation 22 by the drive.

The covering disc 26 is formed from a thin and flexible material which comprises at least one fabric layer of glass fibres or carbon fibres which is preferably coated on both sides with a material having good sliding properties, such as polytetrafluoroethylene. In the present embodiment, the supporting disc 23 is formed in the same manner, but if required, it may instead be formed from a less flexible or non-flexible material.

In order to uncover the feed and discharge station 27 according to the invention, the portion of the flexible covering disc 26 which covers said station 27 is curved up in such a way that at least the feed and discharge station 27 is uncovered. Thus, the ready-bonded textile sheet-like structures 20 can be discharged and unbonded textile sheetlike structures 20 can be placed on the supporting disc 23. The covering disc 26 is curved up by means of a deflecting device 32 which is assigned to the covering disc 26 from above in a stationary manner. Accordingly, the deflecting device 32 does not corotate with the covering disc 26, but is attached to the support base 21 (FIG. 2).

The deflecting device 32 is designed such that a circle segment 33 of the covering disc 26 which is presently located in the region of the feed and discharge station 27 is curved towards the axis of rotation 22 in an approximately U-shaped manner (FIG. 3). For this purpose, the deflecting device 32 comprises several elongate deflecting rollers 34, 35 which all extend in parallel and almost extend completely across the covering disc 26. A group of five freely rotatable deflecting rollers 34 is assigned to an outer side 36 of the covering disc 26 which is directed away from the supporting disc 23. Four of these deflecting rollers 34 are distributed over an approximately semicircular track. A fifth deflecting roller 34 extends this semicircular track in a rectilinear manner. A (further, sixth) deflecting roller 35 is assigned to an inner side 37 of the covering disc 26 which side is directed towards the supporting disc 23. This deflecting roller 35 is located slightly offset behind the middle of the first two deflecting rollers 34 at the outer side 36 of the covering disc 26 (FIG. 3). The deflecting roller 35 serves for lifting the circle segment 33 off the supporting disc 23, while the other deflecting rollers 34 guide the curved circle segment 33 of the covering disc 26 in a U-shaped manner.

The oppositely situated end sides of all deflecting rollers 34 and 35 are mounted to freely rotate on a holding plate 38, which is attached to the support base 21 by means of brackets 39 (FIG. 2). The holding plates 38 are designed such that the circle segment 33 of the covering disc 26 can pass through the Unshaped curved track of the circle segment 33 inbetween the deflecting rollers 34 and 35.

While it is rotating in the direction of rotation 25, the covering disc 26 continuously passes through the aforedescribed deflecting device 32 with the circle segment 33. In this process, different portions of the covering disc 26 keep entering the region of the feed and discharge station 27 and are curved up, i.e. moved away from the supporting disc 23, and are deposited back onto the supporting disc 23 after leaving the feed and discharge station 27. Thus, a segment of a circle 33 forms in the region of the feed and discharge station 27 which is almost invariable in size and always maintains its position relative to the feed and discharge station 27, although the circle segment 33 is always formed from different portions of the covering disc 26 which merge into one another "fluidly".

As a result of the thin and flat design of the supporting disc 23 and the covering disc 26 which receive the textile pieces to be bonded and cover both sides of said pieces, the hot pressing station 28 is designed in a special way. The hot pressing station 28 comprises a pressure means in the form of a pressure cushion 40. The pressure cushion 40 is made from two flexible membranes 41 and 42 which are connected to one another along their edges in an airtight manner so that the pressure cushion 40 can inflate when especially compressed air is blown into a cavity 43 formed between the membranes 41 and 42. The pressure cushion 40 is attached underneath a supporting plate 44 above the covering disc 26. The supporting plate 44 is connected to a pressure yoke 45 which is rigidly connected to the support base 21 (FIG. 3).

A counter pressing plate 46 is arranged opposite the pressure cushion 40, particularly underneath the supporting disc 23. A top side 47 of the counter pressing plate 46 projects through a recess 48 in the supporting plate 24 and directly abuts the underside of the supporting disc 23 (FIG. 3). The counter pressing plate 46 is attached to a second pressure yoke 49, which is fixedly attached to the support base 21.

In this embodiment, the counter pressing plate 46 has several layers. It comprises a heating plate 50 abutting the underside of the supporting disc 23, followed thereunder by insulating plates 51 and a supporting plate 52 connected to the pressure yoke 49.

Inbetween the pressure processes, the pressure cushion 40 is held in the region of the hot pressing station 28 in a pressureless manner, particularly by means of tension springs 53 assigned to the edges of the interconnected membranes 41 and 42. The edges of the membranes 41 and 42 are drawn apart by the tension springs 53. As a result, the membranes 41 and 42 are moved together and are lifted off the outer side 36 of the covering disc 26 (FIG. 4).

In order to bond the textile pieces, compressed air is blown into the cavity 43 of the pressure cushion 40 through a supply pipe 78. As a result, the pressure cushion 40 expands because of an increase of the distance between the membranes 41 and 42 and presses against the region of the outer side 36 of the covering disc 26 which is presently located underneath the pressure cushion 40. As a result of the elastic design of at least the lower membrane 42, the latter places itself snugly against the contour of the covering disc 26, particularly against the region of a bulge of the covering disc 26 which is formed by the textile sheet-like structures 20 which are to be bonded (FIG. 5). During the pressing process, the counter pressing plate 46 is neither moved up nor down and remains stationary. A comparison of FIG. 4 and FIG. 5 shows that the travel of the membranes 41 and 42 of the pressure cushion 40 between the pressing position (FIG. 5) and the deflated position (FIG. 4) is only very small. Thus, the pressure cushion 40 can be moved into and out of the pressing position very rapidly, which leads to short working cycles.

FIGS. 6 and 7 illustrate a second exemplary embodiment of the apparatus which only differs from the afore described first embodiment of the apparatus with respect to the structure of the hot pressing station 28. In this hot pressing station 28, a counter pressing plate 54 is fixedly assigned to the outer side 36 of the covering disc 26. A pressure cushion 55 whose structure is similar to that of the pressure cusion 40 is located underneath the supporting disc 23. But the pressure cushion 55 is not directly assigned to the supporting disc 23. Instead, a movable pressing plate 57 is located between the pressure cushion 55 and the bottom side 56 of the supporting disc 23. This pressing plate 57 is made from several parts. On its top side, which is directed towards the supporting disc 23, the pressing plate 57 has a heating plate 58 which is bolted with a guide plate 59. Several insulating plates 60 are located between the guide plate 59 and the heating plate 58. The guide plate 59 is guided to be movable up and down on guide columns 61 which are laterally assigned to the guide plate 59. Compression springs 62 are arranged on the guide columns 61 in such a way that they press against the guide plate 59 from above, so that the whole pressing plate 57 is moved down and presses together the membranes 41 and 42 of the pressure cushion 55 when it is not inflated with compressed air (FIG. 6). When the pressure cushion 55 is inflated with compressed air, it expands and thus presses the pressing plate 57 against the bottom side 56 of the supporting disc 23 and at the same time biases the compression springs 62 on the guide columns 61 (FIG. 7).

The advantage of arranging the pressure cushion 55 underneath the movable pressing plate 57, as described hereinabove,. is that the heating plate 58 does not transfer any heat to the pressure cushion 55 because of the insulating plates 60 located between the heating plate 58 and the guide plate 59. As a result, the compressed air in the pressure cushion 55 can not heat up in the course of the pressing process and the pressure remains nearly invariable.

In the illustrated embodiment, the rigid counter pressing plate 54 which is assigned to the outer side 36 of the covering disc 26 is formed from an elastic material, so that it can precisely adapt to the contour of the covering disc 26 which is partly bulged by the textile sheet-like structure 20 (FIG. 7).

FIGS. 8 to 10 illustrate a third exemplary embodiment of the apparatus which differs from the afore described apparatuses because it comprises a third work station. In addition to the feed and discharge station 27 and the hot pressing station 28, this embodiment comprises a cold pressing station 63 which follows the hot pressing station 28. All three work stations are evenly distributed over the periphery of the supporting disc 23 or covering disc 26. The deflecting device 32 for curving up a portion of the covering disc 26 is again located in the region of the feed and discharge station 27. In the illustrated exemplary embodiment, the deflecting device 32 is located slightly further away from the axis of rotation 22 of the supporting disc 23 and the covering disc 26 than in the other two afore described exemplary embodiments. This ensures that the covering disc 26 completely rests on the supporting disc 23 in the regions of the hot pressing station 28 and the cold pressing station 63 (FIG. 9).

Another outstanding feature of the presently illustrated apparatus is that a pressure yoke 64 of the hot pressing station 28 extends to the center of the supporting disc 23, bends at an (obtuse) angle and further extends to the cold pressing station 63. In the bending region, the pressure yoke 64 is connected to the support base 21 via an upright column 65 located on the axis of rotation 22. The flanges 29 for connecting the supporting disc 23 with the covering disc 26 are rotatably mounted on this immovable column 65. The flanges 29 are driven by a toothed wheel 66 which is also rotatably mounted on the column 65 and is geared to a partially shown pinion 67 of a drive motor which is not shown (FIG. 10).

In the presently illustrated apparatus, the hot pressing station 28 is designed like that of the apparatus of the first exemplary embodiment, i.e. analogous to FIGS. 3 to 5. Nevertheless, it would also be possible to design the hot pressing station 28 of the present apparatus like that of the second exemplary embodiment of the invention according to FIGS. 6 and 7.

FIGS. 11 to 13 illustrate a fourth exemplary embodiment of the apparatus according to the invention, which comprises five work stations, particularly a feed station 68, a first hot pressing station 69, a second hot pressing station 70, a cooling station 71 and a discharge and stacking station 72 (FIG. 12).

In the present embodiment, the deflecting device 32 is assigned to the covering disc 26 in such a way that the covering disc 26 can be curved up to such an extent that it is (simultaneously) deflected from the supporting disc 23 in the feed station 68 and in the discharge and stacking station 72 (FIG. 11). The deflecting device 32 may be designed in the way which has been described with respect to the first exemplary embodiment of the invention.

In this embodiment, the discharge and stacking station 72 is designed in a special way. In order to further automatize the apparatus, the discharge and stacking station 72 comprises a stacker 73 which is fixedly arranged above the covering disc 26, particularly at such a distance that a stationary cantilever arm 74 of the stacker 73 extends from the axis of rotation 22 radially to the outside and projects beyond the deflecting device 32 with the curved circle segment 33 of the covering disc 26 (FIG. 13). A grab 75, which preferably operates pneumatically, is arranged underneath the cantilever arm 74 in such a way that it can move to and fro in the radial direction. The grab 75, which is shown in a grabbing position in FIG. 13, picks up the bonded textile sheet-like structure 20 from the discharge and stacking station 72 and transports it to the outside to an end position shown in dot-dash lines in FIG. 13. In this end position, the grab deposits the textile sheet-like structure 20 on a stack 76 of previously deposited textile sheet-like structures 20. This stack 76 is located on a (rectilinear) belt conveyor 77 which preferably conveys in the radial direction relative to the supporting disc 23. This belt conveyor 77 can be driven intermittently, such that a full stack can be moved away from the dot-dashed region of the end position of the grab 75, so that the grab 75 can deposit a new stack 76 on the belt conveyor 77. The completed stack 76 can be taken off the belt conveyor 77 manually or mechanically.

I claim:

1. An apparatus for bonding textile sheet-like structures, especially collars, cuffs and the like, with a rotatably drivable receiving means for further transporting the textile sheet-like structures which comprises several work stations, and with at least one covering means which is movable together with the receiving means and which covers the textile sheet-like structures in the region of at least one work station, characterized in that the covering means is in the form of an elastically deformable covering disc (26) which is operatively connected to a deflecting device (32) and can be curved up by the deflecting device (32) in such a way that the receiving means is uncovered in the region of at least one work station in order to feed and/or discharge textile sheetlike structures.

2. The apparatus as claimed in claim 1, wherein the deflecting device (32) is fixedly arranged in the region of the work station or work stations which can be uncovered by the covering disc (26).

3. The apparatus as claimed in claim 1, wherein the deflecting device (32) is assigned to a work station which is designed as a combined feed and discharge station (27).

4. The apparatus as claimed in claim 1, wherein the deflecting device (32) is assigned to two adjacent work stations, to a feed station (68) and a discharge and stacking station (72).

5. The apparatus as claimed in claim 1, comprising a single covering disc (26) which extends over all work stations.

6. The apparatus as claimed in claim 1 or 5, wherein the covering disc (26) conducts a movement relative to the immovable deflecting device (32) in order to curve up in a guided manner.

7. The apparatus as claimed in claim 6, wherein the deflecting device (32) comprises a guide track through which a portion of the covering disc (26), an edge portion in the form of a segment of a circle (33), is passed continuously while the covering disc (26) is driven.

8. The apparatus as claimed in claim 7, wherein the deflecting device (32) comprises guide means (34, 35) for curving up the circle segment (33) of the covering disc (26) in an approximately U-shaped manner.

9. The apparatus as claimed in claim 8, wherein the guide means are in the form of deflecting rollers (34, 35) which are grouped together to form a U-shaped deflecting track.

10. The apparatus as claimed in claim 9, wherein the deflecting rollers (34, 35) are assigned to opposite sides of the deflecting track, such that the deflecting rollers (34, 35) guide at least portions of opposite sides (outer side 36; inner side 37) of the circle segment (33) which is to be curved up.

11. The apparatus as claimed in claim 10, wherein the deflecting rollers (34, 35) are mounted in a freely rotatable manner in support means (holding plate 38; brackets 39) which are designed in such a way that opposite end sides of the deflecting track are open so that the circle segment (33) of the covering disc (26) continuously passes through the deflecting device (32).

12. The apparatus as claimed in claim 1, wherein the receiving means is in the form of a supporting disc (23).

13. The apparatus as claimed in claim 12, comprising a stationary (non-rotatable) supporting plate (24) which is arranged underneath the supporting disc (23) and on which the supporting disc (23) rests.

14. The apparatus as claimed in claim 12, wherein the supporting disc (23) as well as the covering disc (26) are drivable to rotate about a common axis of rotation (22).

15. The apparatus as claimed in claim 14, wherein the supporting disc (23) and the covering disc (26) have circular surface areas of approximately equal size.

16. The apparatus as claimed in claim 14, wherein the covering disc (26) and/or the supporting disc (23) are made of a thin fabric which is coated with at least one adhesive surface layer, said fabric being made especially from glas fibres or carbon fibres.

17. The apparatus as claimed in or more of claim 12, wherein at least one work station which is in the form of a hot pressing station (28, 69, 70) is associated with a sheet-like pressure means (pressure cushion 40, 55) which is deformable by means of a pressure medium, especially compressed air.

18. The apparatus as claimed in claim 17, wherein the pressure means (pressure cushion 40) is directly assigned to an outer side (36) of the covering disc (26).

19. The apparatus in claims 17 or 18, wherein the pressure means (pressure cushion 55) is associated with a movable pressing plate (57) which is movable up and down by the pressure means (pressure cushion 55) and which, in an upper position, rests against the supporting disc (23) from underneath.

20. The apparatus as claimed in claims 17, wherein the hot pressing station (28, 69, 70) has at least one heating plate (50, 58).

21. The apparatus as claimed in claim 20, wherein the heating plate (50, 58) is assigned to one of a movable pressing plate (57) and a stationary counter pressing plate (46).

22. The apparatus as claimed in claim 21, wherein a the side of the heating plate (50, 58) which is directed away from the supporting disc (23) or covering disc (26) is provided with an insulation formed from at least one insulating plate (51, 60).

* * * * *